US005164571A

United States Patent [19]

Asaoka et al.

[11] Patent Number: 5,164,571

[45] Date of Patent: Nov. 17, 1992

[54] RADIANT HEATING APPARATUS FOR EVAPORATING WATER FROM AN AQUEOUS COATING

[75] Inventors: Yukio Asaoka; Hitoshi Yano, both of Toyota; Touichi Watanabe, Yokohama, all of Japan

[73] Assignee: Trinity Industrial Corporation, Tokyo, Japan

[21] Appl. No.: 587,852

[22] Filed: Sep. 25, 1990

[30] Foreign Application Priority Data

Sep. 25, 1989 [JP] Japan ..... 1-111929

[51] Int. Cl.[5] ..... H05B 1/02

[52] U.S. Cl. ..... 219/502; 219/497; 219/501; 356/408; 356/402

[58] Field of Search ..... 219/502, 497, 494, 501, 219/506, 491; 356/45, 402, 408, 421

[56] References Cited

U.S. PATENT DOCUMENTS

| | | | |
|---|---|---|---|
| 4,180,722 | 12/1979 | Clewans | 219/502 |
| 4,245,148 | 1/1981 | Gisske et al. | 219/502 |
| 4,356,370 | 10/1982 | Horinouchi | 219/506 |
| 4,363,957 | 12/1982 | Tachikawa et al. | 219/497 |
| 4,693,179 | 9/1987 | Watts | 219/502 |
| 4,698,767 | 10/1987 | Wensel et al. | 219/502 |

*Primary Examiner*—Mark H. Paschall
*Attorney, Agent, or Firm*—Spencer, Frank & Schneider

[57] ABSTRACT

A heating apparatus for use in the process of coating workpieces with an aqueous colored material such as a water-base paint. Radiant heaters are used in a flash-off operation to remove moisture from the coating material on the workpieces while the workpieces are transported between the heaters. The coating color is specified in advance, and an optimal moisture removal operation is performed by automatically regulating the radiant heat intensity suitable for the specified color.

10 Claims, 2 Drawing Sheets

RADIANT HEATING APPARATUS FOR EVAPORATING WATER FROM AN AQUEOUS COATING

BACKGROUND OF THE INVENTION

In a coating process using organic solvent type coating material, there are strong demands in recent years that complete separation and recovery of the volatile organic solvents be performed without discharging them to outside the process, i.e. out of the coating facilities, to prevent pollution, particularly because of the restriction on photochemical smog. However, in the coating process of a large size workpiece such as a car body, aqueous (water base; water-soluble) coating materials are now used, which contain solvents based on water instead of organic solvent coating materials because complete separation and recovery of solvents not only causes an economical burden and requires enlargement of large facilities but also gives no ultimate solution to the problem.

In the meantime, such aqueous coating materials cause some inconveniences in subsequent processes because water is evaporated much slower than organic solvents. Namely, when coating is performed on a wet-on-wet basis, dripping occurs, while, when the coated workpiece placed into an oven, bubbling occurs. Accordingly, it is necessary to provide a process (hereinafter referred to as "flash-off process") for evaporation to evaporate water to a certain extent before proceeding to the subsequent processes.

However, when this flash-off process is turned to spontaneous evaporation type, long time is required for flash-off because evaporation speed of water is slow. For this reason, the flash-off zone must be extended. This means that larger facilities are required.

In this respect, it has been proposed to shorten the flash-off time by positively heating the workpiece in the flash-off process.

As a heating apparatus for such purpose, a radiation (radiant) heating system using a (radiant) radiation heater is suitable for initial heating, as described in the Japanese Patent Publication No. 52-30170, because this system is free of the disadvantages of the convection heating system, such as suspended dust, and the disadvantages of the induction heating system, such as complicated facilities and the restriction on the workpieces, and because quick heating can be accomplished.

However, when this heating apparatus is adopted, a wide variety of workpieces are transported to the flash-off zone one after another. Then, some of the workpieces may be dried up, and the quality of coating may be decreased.

SUMMARY OF THE INVENTION

The object of the present invention is to offer a heating apparatus for use in a coating process, which can achieve optimal flash-off by automatically regulating radiant heat intensity based on the coating color of the workpieces.

Specifically, according to the study of the present applicant, the quantity of absorbed radiant heat, i.e. the temperature rise, differs according to the color of the material coating the workpieces, whereas it has been found from practical experience in performing the coating process that the influence by of the difference in the coating colors is surprisingly strong.

Thus, the present invention provides a heating apparatus for use in the coating process, comprising a radiant heater for radiant heating of a workpiece coated with aqueous coating material and a power unit, characterized in that coating color specifying means are provided for specifying the coating color of said workpiece carried toward the front of said radiant heater, and that control means are provided for controlling said power unit in order to obtain a radiant heat ray intensity suitable for the specified color.

Therefore, the color of the aqueous coating material with which the workpiece is to be coated is specified in advance by the coating color specifying means. When said workpiece is carried toward the front of the radiant heater, the control means control the power unit in order to obtain the radiant heat intensity suitable for said specified color. Thus, without a need to take into account a complicated procedure such as a changing speed of the transport means and without decreasing the productivity, a quick and satisfactory flash-off operation can be performed, and a coating of high quality can be obtained.

Namely, because the coating color specifying means and the control means are provided according to this invention and because the intensity of radiant heat ray is automatically regulated to an optimal value for each coating color of the workpiece, complicated and careful adjustment is not required, and an adequate and satisfactory flash-off operation can be achieved without decreasing productivity regardless of the coating color of the workpiece.

Figure 1:
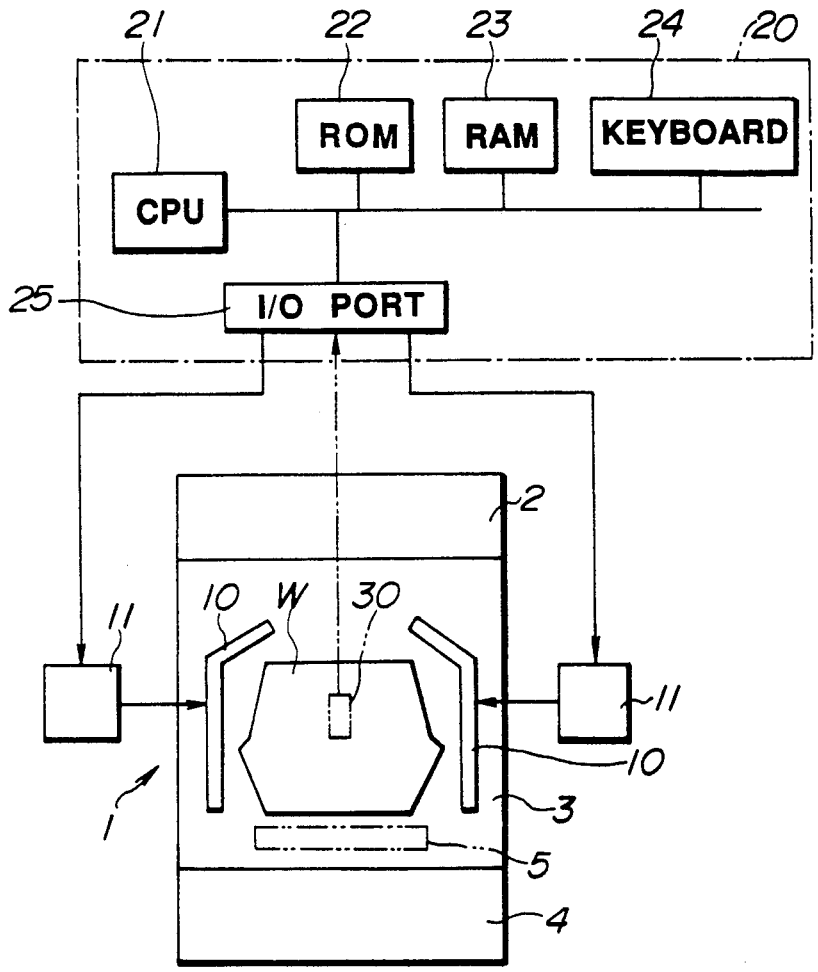
FIG. 1 is a diagram to show a first embodiment and a second embodiment of this invention.

1 Flash-off zone
2 Air supply chamber
3 Radiation heating chamber
4 Exhaust air processing chamber
5 Transport means to transport workpiece
10 Radiant heater
11 Power unit
20 Control means for drive control of the entire coating apparatus
21 CPU
22 ROM
23 RAM
24 Keyboard
30 Color detector

DESCRIPTION OF THE PREFERRED EMBODIMENTS

In the following, the embodiments of the invention will be described in connection with drawings.

Embodiment 1

In FIG. 1 (block diagram), reference numeral 1 refers to a flash-off zone, which comprises an air supply chamber 2, a radiant heating chamber 3, and an exhaust air processing chamber 4. The workpiece W coated with aqueous coating material is transported by the transport means 5 from the depth of the paper and is automatically transported to the subsequent processes through a spontaneous evaporation region, which is supposed to be on this side of the paper surface.

Reference numeral 10 designates two radiant heaters, one on each side of the workpiece W transported to the flash-off zone 1. Reference numeral 11 designates the power units for the radiant heaters.

Reference numeral 20 designates a control means to drive the entire coating apparatus in this embodiment, and includes a CPU 21, a ROM 22, a RAM 23, a keyboard 24, an I/O port 25, etc. connected by a bus.

Here, the coating color specifying means consists of CPU 21, ROM 22, RAM 23, etc., and the control means consists of CPU 21, etc.

Namely, in the past, when the workpiece W is transported in front of the radiant heaters 10 by the transport means 5, the control means 20 turns on the power units 11 and then off through I/O port 25. According to the present invention, the coating color of the workpiece W is specified in advance, and the intensity of the radiant heat is automatically regulated according to the specified color. For the this purpose, the data for coating color and radiant heat intensity, i.e. the data corresponding to the coating color and radiant heat intensity are stored in ROM 22, which constitutes the coating color specifying means. CPU 21 specifies the coating color of the workpiece to be transported to the radiant heating chamber 3 in accordance with the transport program of the workpiece W, stored in ROM 22, and this is stored temporarily in RAM 23. At the same time, the radiant heat intensity corresponding to said specified color is read from ROM 22, and this is stored temporarily in RAM 23. This coating color specifying program (the steps 10, 12 and 14 in FIG. 2) is stored in ROM 22.

CPU 21, constituting the control means, performs drive control of the power units 11 for a predetermined time according to the radiant heat intensity data temporarily stored in RAM 23. It is to execute the control program (the steps 16, 18 and 20), which is to be turned off after a predetermined time. The coating color and radiant heat intensity are reloadable in ROM 22.

In this embodiment, the data are input on the keyboard 24 before starting the operation and are stored in RAM 23, such as how many workpieces are to be produced with which color and by what kind of sequence.

The radiant heater 10 in this embodiment is an infrared (e.g. near infrared - medium infrared) radiant heating system. Accordingly, the response speed is quick, and radiation intensity is easily controllable.

Figure 2:
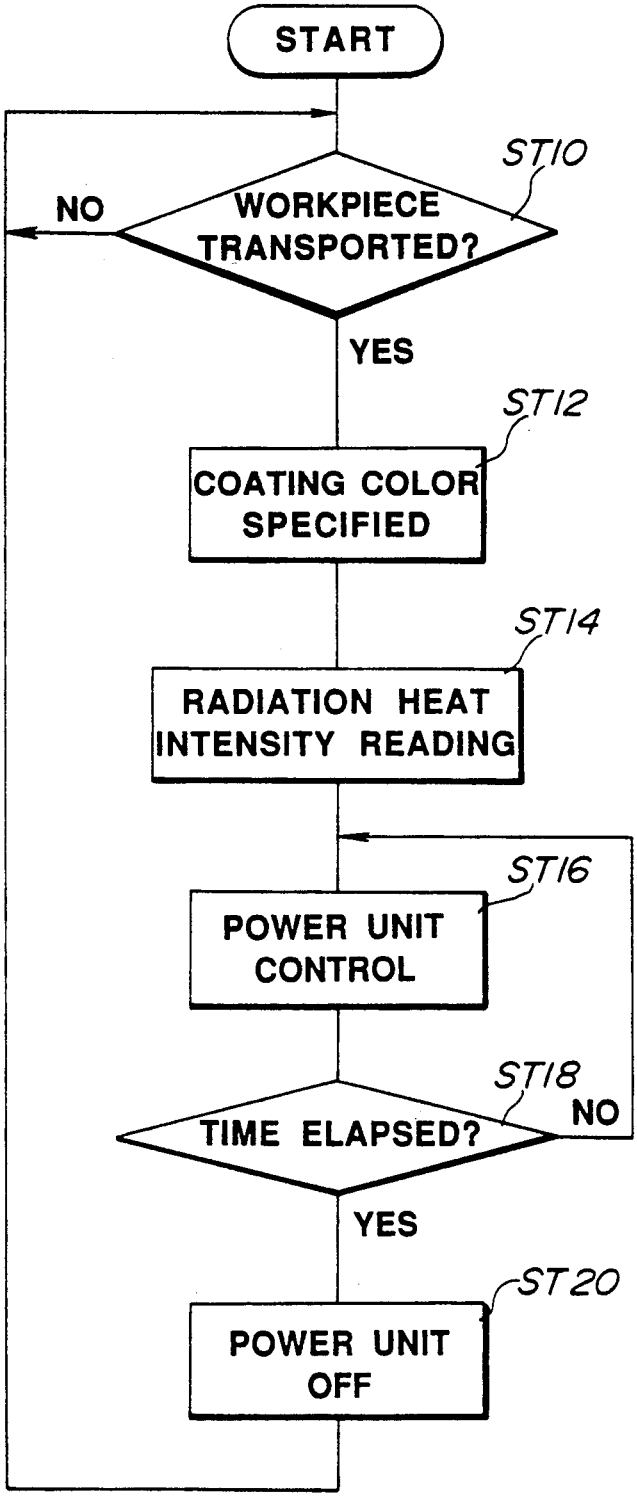
FIG. 2 is a flow chart to explain the operation of the same.

In the present embodiment with such an arrangement, CPU 21 reads out and specifies the coating color of the workpiece W to be transported to the radiant heat chamber 3 from RAM 23 while commanding the predetermined operation of the transport means 5 (steps 10 and 12 in FIG. 2). Then, said radiant heat intensity is read out from ROM 22 and is stored in RAM 23 (step 14).

Thereafter, CPU 21, constituting the control means, performs drive control on the power units 11 for a predetermined time in order to output radiant has at said radiant heat intensity (steps 16 and 18). Therefore, the workpiece W as it is transported at a constant speed is heated to the preset temperature while it passes between the radiant heaters 10, and a flash-off operation optimal for the specified color is performed.

Then, the power units 11 are turned off in step 20.

According to this embodiment 1, the coating color specifying means (21, 22 and 23) and the control means (21) are provided, the coating color of the workpiece W to be transported to the radiant heating chamber 3 is specified, and the drive control of the power units 11 is performed to output radiant heat at the optimal radiant heat intensity for the specified coating color. Thus, it is possible to adequately and quickly dry the workpiece W coated with aqueous coating material, and a coating of high quality can be obtained. Moreover, because the workpiece can be dried as desired within predetermined time even when the coating color is changed, diversified requirements are satisfied and productivity is increased.

Embodiment 2

In contrast to the embodiment 1, in which the coating color is specified according to the order of transport of the workpieces W, the coating color is directly specified according to the embodiment 2 by providing a color detector 30, which is shown by the two-dot chain line in FIG. 1.

Specifically, when the specified coating color is detected by the color detector 30 when the workpiece W is transported to the radiant heating chamber 3, CPU 21 temporarily memorizes this detected coating color as the specific color in RAM 23. The radiant heat intensity is read out from ROM 22, and it is similarly stored in RAM 23.

CPU 21, working as a control means, functions in the same manner as in the embodiment 1.

Consequently, the same operational effect as in the embodiment 1 can be obtained in the embodiment 2 with an adequate and quick flash-off operation. Further, there is no need to input the coating color and the number of workpieces to be produced on the keyboard before starting the operation, and the productivity is extensively increased.

In the above embodiments, the coating colors of the workpieces W are indirectly or directly specified, whereas an item number, e.g. a car number, inputted before the operation is started. Instead of color detector 30, a detector of the car number or other identification number may be furnished, and coating color may be specified from a car number or other identifier.

What is claimed is:

1. An apparatus for removal of moisture from an aqueous material coating a workpiece, comprising:

means for applying radiant heat to the coated workpiece in a flash-off zone;

means for storing data indicative of different colors of the material and optimum radiant heat intensity valves corresponding to the colors, and for storing a program of instructions for transporting the workpiece to and through the flash-off zone via a transporting means; and means, responsive to color data prior to the workpiece reaching the flash-off zone, the color data indicative of a color of the material coating the workpiece, for reading the data in said storing means indicative of the optimum radiant heat intensity value corresponding to the color indicated by the color data, driving said radiant heat applying means to apply radiant heat to the coated workpiece while the coated workpiece is in the flash-off zone, and controlling the intensity of radiant heat applied to the coated workpiece while the coated workpiece is in the flash-off zone, according to the read data.

2. A heating apparatus according to claim 1, wherein said reading, driving and controlling means drives said radiant heat applying means to apply radiant heat to the coated workpiece for a predetermined period of time.

3. A heating apparatus according to claim 1, wherein the color data is stored in said storing means and read out by said reading, driving and controlling means.

4. A heating apparatus according to claim 3, wherein said reading, driving and controlling means comprises a CPU, and said storing means comprises:

a ROM which stores the data indicative of different colors of the material and optimum radiant heat intensity values corresponding to the colors, and the program of instructions for transporting the workpiece, and a RAM which stores the color data.

5. A heating apparatus according to claim 1, further comprising a color detector for automatically detecting the color of the material coating the workpiece and generating said color data, prior to the workpiece reaching the flash-off zone.

6. A heating apparatus according to claim 1 further comprising means, responsive to the transporting program stored in said storing means, for transporting the coated workpiece through the flash-off zone.

7. An apparatus for removal of moisture from an aqueous material coating a workpiece, comprising:

means for transporting a workpiece coated with an aqueous material to and through a flash-off zone;

means for applying radiant heat to the coated workpiece while the coated workpiece is in the flash-off zone;

means for obtaining, prior to the workpiece being transported through the flash-off zone, color data indicative of a color of the material coating the workpiece; and means for driving said radiant heat applying means to apply radiant heat to the coated workpiece while the coated workpiece is in the flash-off zone, and controlling the intensity of radiant heat applied to the coated workpiece as a function of the color data.

8. A heating apparatus according to claim 7, wherein said driving and controlling means drives said radiant heat applying means to apply radiant heat to the coated workpiece for a predetermined period of time.

9. A heating apparatus according to claim 7, wherein said driving and controlling means comprises a CPU and said means for obtaining comprises a RAM which stores the color data.

10. A heating apparatus according to claim 7, wherein said means for obtaining comprises a color detector for automatically detecting the color of the material coating the workpiece and generating said color data, prior to the workpiece reaching the flash-off zone.

* * * * *